US007175176B2

(12) United States Patent
Becker

(10) Patent No.: US 7,175,176 B2
(45) Date of Patent: Feb. 13, 2007

(54) DEVICE FOR FEEDING SUCTION AIR OR BLOWING AIR IN A SHEET-PROCESSING MACHINE

(75) Inventor: Willi Becker, Bammental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/171,979

(22) Filed: Jun. 29, 2005

(65) Prior Publication Data

US 2005/0236766 A1 Oct. 27, 2005

Related U.S. Application Data

(62) Division of application No. 10/315,343, filed on Dec. 10, 2002, now abandoned.

(30) Foreign Application Priority Data

Dec. 10, 2001 (DE) ..... 101 60 388

(51) Int. Cl.
*B65H 5/18* (2006.01)

(52) U.S. Cl. ..... 271/276

(58) Field of Classification Search ..... 277/585, 277/522, 528, 328, 329, 337, 338; 271/90–108, 271/276

See application file for complete search history.

(56) References Cited

U.S. PATENT DOCUMENTS 2,081,040 A * 5/1937 King ..... 92/244
3,714,993 A * 2/1973 Nolley ..... 173/78
3,764,133 A 10/1973 Gray et al.
3,884,483 A * 5/1975 Fengler et al. ..... 277/585
3,921,970 A * 11/1975 Stanfield ..... 271/31
3,942,336 A * 3/1976 Schultenkamper ..... 464/162
3,957,263 A * 5/1976 Christl ..... 271/102
3,992,993 A 11/1976 Kuhn et al.
4,027,816 A * 6/1977 Slator et al. ..... 277/437
4,043,619 A * 8/1977 Teske et al. ..... 384/446
4,118,024 A 10/1978 Gerhardt
4,290,484 A * 9/1981 Beall et al. ..... 166/242.7
4,343,241 A 8/1982 Rudolph et al.
4,380,331 A 4/1983 Fischer
4,505,469 A * 3/1985 Kakimoto et al. ..... 271/91
4,548,396 A * 10/1985 Nelen ..... 271/90
4,580,773 A * 4/1986 Minkle ..... 271/103
4,591,140 A * 5/1986 Illig et al. ..... 271/11
4,790,244 A 12/1988 Otfried et al.

(Continued)

FOREIGN PATENT DOCUMENTS

CH 440 337 12/1967

(Continued)

*Primary Examiner*—Patrick Mackey
*Assistant Examiner*—Matthew J. Kohner
(74) *Attorney, Agent, or Firm*—Laurence A. Greenberg; Werner H. Stemer; Ralph E. Locher

(57) ABSTRACT

A device for feeding suction air or blowing air to a sheet-retaining device displaceable relative to a machine element in a sheet-processing machine, includes a first air-feeding element connectible in terms of flow to a suction-air or blowing-air source. A second air-feeding element cooperates telescopically with the first air-feeding element for forming an air through-passage duct connected in terms of flow to the sheet-retaining device.

10 Claims, 3 Drawing Sheets

U.S. PATENT DOCUMENTS

| | | | | | |
|---|---|---|---|---|---|
| 4,869,489 | A | | 9/1989 | Wirz et al. | |
| 4,893,823 | A | * | 1/1990 | Strouse et al. | 277/437 |
| 5,163,667 | A | | 11/1992 | Rebeaud | |
| 5,346,230 | A | * | 9/1994 | Schumacher et al. | 277/551 |
| 5,398,925 | A | | 3/1995 | Zeltner | |
| 5,402,868 | A | | 4/1995 | Handke et al. | |
| 5,454,312 | A | | 10/1995 | Helmstaedter et al. | |
| 5,480,138 | A | | 1/1996 | Haupenthal et al. | |
| 5,482,267 | A | | 1/1996 | Haupenthal | |
| 5,511,772 | A | * | 4/1996 | Ganz et al. | 271/12 |
| 5,537,922 | A | | 7/1996 | Becker | |
| 5,538,080 | A | * | 7/1996 | Bassinger | 166/84.2 |
| 5,542,658 | A | * | 8/1996 | Wirz et al. | 271/107 |
| 5,636,688 | A | * | 6/1997 | Bassinger | 166/84.4 |
| 5,741,275 | A | | 4/1998 | Wyssmann | |
| 5,911,607 | A | * | 6/1999 | Lacko et al. | 440/83 |
| 6,070,866 | A | | 6/2000 | Wepfer | |
| 6,076,645 | A | * | 6/2000 | Winkelmann et al. | 192/85 CA |
| 6,089,157 | A | | 7/2000 | Becker et al. | |
| 6,098,543 | A | | 8/2000 | Becker et al. | |
| 6,209,882 | B1 | * | 4/2001 | Riess | 277/562 |
| 6,254,089 | B1 | | 7/2001 | Becker et al. | |
| 6,254,094 | B1 | | 7/2001 | Becker et al. | |
| 6,401,610 | B1 | | 6/2002 | Becker et al. | |
| 6,450,493 | B1 | | 9/2002 | Milillo et al. | |
| 6,619,201 | B1 | | 9/2003 | Becker et al. | |
| 6,626,438 | B2 | * | 9/2003 | Walden | 277/510 |
| 6,752,392 | B2 | | 6/2004 | Fricke et al. | |
| 6,851,361 | B2 | | 2/2005 | Görbing et al. | |

FOREIGN PATENT DOCUMENTS

| | | | | |
|---|---|---|---|---|
| DE | 24 51 987 | C3 | | 9/1975 |
| DE | 36 40 805 | A1 | | 10/1987 |
| DE | 37 10 994 | C2 | | 10/1988 |
| DE | 691 04 112 | T2 | | 10/1991 |
| DE | 43 15 515 | C2 | | 11/1994 |
| DE | 43 32 491 | A1 | | 3/1995 |
| EP | 425960 | A2 | * | 5/1991 |
| EP | 0 453 985 | B1 | | 10/1991 |
| EP | 0 641 652 | A1 | | 3/1995 |
| EP | 0 976 554 | A1 | | 2/2000 |
| GB | 1 462 745 | | | 1/1977 |

* cited by examiner

DEVICE FOR FEEDING SUCTION AIR OR BLOWING AIR IN A SHEET-PROCESSING MACHINE

CROSS-REFERENCE TO RELATED APPLICATIONS

This is a divisional of application Ser. No. 10/315,343, filed Dec. 10, 2002 now abandoned, claiming the priority, under 35 U.S.C. §119, of German Patent Application 101 60 388.6, filed Dec. 10, 2001. The prior applications are herewith incorporated by reference in their entirety.

BACKGROUND OF THE INVENTION

Field of the Invention

The invention relates to a device for feeding suction air or blowing air in a sheet-processing machine, in particular a sheet-fed rotary printing machine.

In sheet-fed rotary printing machines, the paper sheets which are to be printed are removed from a sheet pile and, with the aid of grippers disposed on rotating cylinders, transported through the individual printing units of the printing machine, in order to be printed with one, two or more colors. The grippers in regard thereto are fastened in a conventional manner on gripper shafts which are accommodated in a channel or gap formed in the periphery of the respective cylinders of the printing machine.

In the case of heretofore-known sheet-fed rotary printing machines, the sheets are reversed or turned with the aid of reversing or turning devices including one or more suction grippers which are pivotable out of the periphery of a cylinder of the reversing or turning device, engage the trailing edge of the sheets which are to be reversed or turned and, after the suction grippers have been pivoted back into the periphery of the cylinder, transfer the sheets to a further gripper device. After it has received the trailing sheet edge, the further gripper device is pivoted counter to the direction of rotation of the rotating cylinder of the reversing or turning device, and transfers the trailing sheet edge, as a new leading sheet edge, to the gripper device of a downstream cylinder, for example to the grippers of an impression cylinder of the printing unit disposed downstream from the reversing device, as viewed in a travel direction of the sheet, for the purpose of printing the rear side of the sheet.

In order to attach by suction the trailing edge of the sheets which are to be reversed or turned, the suction grippers are subjected to the action of suction air, which is produced by an external suction-air source, and is fed to the suction head of the suction gripper via a rotary valve and a usually flexible supply line.

In practice, that results in a problem in that the suction grippers or suckers, for the purpose of gripping the trailing sheet edge, have to execute very large and different movements in order to be able to compensate for the movement of the reversing or turning drum and the movement of the upstream sheet-carrying impression cylinder rotating relative to the reversing or turning drum. The suckers or suction grippers are pivoted here via gear mechanisms or transmissions involving a high mechanical outlay or expenditure, as is described, for example, in German Patent DE 24 51 987 C3, corresponding to British Patent 1 462 745; European Patent Application 0 976 554 A1, corresponding to U.S. Pat. No. 6,401,610; and European Patent Application 0 641 652 A1, corresponding to U.S. Pat. No. 5,413,040.

Due to the comparatively long pivoting paths which the suction grippers have to cover, as well as to the number of degrees of freedom which the suction grippers require in order to be able to grip the sheets optimally, the suction air is fed, in the case of the heretoforeknown suction grippers, via flexible hose lines. By using flexible hose lines, however, the problem arises that the hose lines which, on the one hand, have to be flexible, on the other hand, should be of a high enough strength for the hose not to contract due to the negative pressure or vacuum produced in the interior of the hose after the sheet has been gripped. In practice, the hoses are thus selected to be comparatively long and disposed in generously sized loops in order to be able to perform the necessary rotary movements and pivoting movements of the suction grippers over an extended period without an excessively large amount of material wear. Furthermore, the use of long hose lines also frequently results, in practice, in a space problem and, due to the centrifugal force and the movement of the grippers, the danger arises that the hose lines will rub against other components and be thereby, in this manner, exposed to increased wear.

A further disadvantage of the long hose lines is that the volume of the line between a control valve, for example a rotary valve for switching the suction air on and off, and the suction gripper, as such, is increased to a considerable extent. That results, in turn, in an increase in the time taken to build up the negative pressure once the control valve has been opened, which, in particular in the case of high machine speeds, adversely affects the suction process.

It has become known heretofore from German Published, Non-prosecuted Patent Application DE 43 32 491 A1 for a feed line for suction air or blowing air to a sucker in a sheet-fed rotary printing machine to be constructed as a conventional pipe joint. The pipe joint thereby permits a straightforward rotary movement of the suckers, and prevents the sucker from executing a linear movement in addition to rotary movement.

SUMMARY OF THE INVENTION

It is accordingly an object of the invention to provide a device for feeding suction or blowing air to a sheet-retaining configuration in a sheet-processing machine, which overcomes the hereinafore-mentioned disadvantages of the heretofore-known devices of this general type, which is displaceable relative to a machine element and which permits both a linear, as well as a rotary or pivoting movement of the sheet-retaining configuration.

With the foregoing and other objects in view, there is provided, in accordance with the invention, a device for feeding suction air or blowing air to a sheet-retaining device displaceable relative to a machine element in a sheet-processing machine. The device comprises a first air-feeding element connectible in terms of flow to a suction-air source or a blowing-air source. A second air-feeding element cooperates telescopically with the first air-feeding element for forming an air through-passage duct connected in terms of flow to the sheet-retaining device.

In accordance with another feature of the invention, the sheet-processing machine is a sheet-fed rotary printing machine having a reversing device, and the machine element is a suction gripper of the reversing device, which is pivotable out of the periphery of a cylinder of the printing machine.

In accordance with a further feature of the invention, the second air-feeding element is displaceable at least approximately linearly in relation to the first air-feeding element.

In accordance with an added feature of the invention, the first and second air-feeding elements include a first and a second hollow tube insertable telescopically inside one another.

In accordance with an additional feature of the invention, the first hollow tube has an external diameter corresponding approximately to an internal diameter of the second hollow tube. This is done for forming, between the outer surface of the first hollow tube and the inner surface of the second hollow tube, a sliding gap serving for reducing an escape of leakage air.

In accordance with yet another feature of the invention, the outer surface of the first hollow tube and the inner surface of the second hollow tube are formed of different materials.

This affords wear-free dry running of the first hollow tube in relation to the second hollow tube.

In accordance with yet a further feature of the invention, the different materials are plastic material and metal.

In accordance with yet an added feature of the invention, the first hollow tube is sealed by a sealing element with respect to the second hollow tube against an escape of leakage air.

In accordance with yet an additional feature of the invention, the sealing element is formed by a folding bellows enclosing at least one of the first and the second hollow tubes. This is done for preventing leakage air from escaping between the first and the second hollow tubes.

In accordance with another feature of the invention, the sealing element includes an axially displaceable internally conical ring engaging around an end of the second hollow tube, and a threaded nut screwable onto a thread formed on the second hollow tube for compressing the second hollow tube by displacement of the internally conical ring in radial direction.

In accordance with a further feature of the invention, the sealing element is formed by a first sliding sealing ring disposed between the outer surface of the first hollow tube and the inner surface of the second hollow tube, and fastened onto the first hollow tube.

In accordance with an added feature of the invention, fastened onto the inner surface of the second hollow tube is a second sliding sealing ring. The second sliding sealing ring, together with the first sliding sealing ring, defines an annular interspace between the outer surface of the first hollow tube and the inner surface of the second hollow tube.

In accordance with an additional feature of the invention, the second sliding sealing ring is a closing sealing ring disposed at an end of the second hollow tube.

In accordance with yet another feature of the invention, the annular interspace is connected in terms of flow, via a first connecting bore, to an air through-passage duct for guiding suction air or blowing air in the interior of the first hollow tube.

In accordance with yet a further feature of the invention, the annular interspace and the air through-passage duct in the second hollow tube have cross-sectional surface areas of such size that axial forces producible by the suction air or blowing air in the annular interspace and in the air through-passage duct and acting upon the first and second hollow tubes, at least approximately cancel one another out.

In accordance with yet an added feature of the invention, the cross-sectional surface area of the annular interspace and the cross-sectional surface area of the air through-passage duct in the second hollow tube are of such size that the forces producible by suction air in the annular interspace and serving for moving the first hollow tube and the second hollow tube away from one another, are greater than the forces which are producible by the suction air in the air through-passage duct and serve for moving the first hollow tube and the second hollow tube towards one another.

In accordance with a concomitant feature of the invention, the cross-sectional surface area of the annular interspace and the cross-sectional surface area of the air through-passage duct in the second hollow tube are of such magnitude that the forces which are producible by suction air in the annular interspace and serve for moving the first hollow tube and the second hollow tube away from one another, are smaller than the forces which are producible by the suction air in the air through-passage duct and serve for moving the first hollow tube and the second hollow tube towards one another.

The air feeding device according to the invention offers the advantage of shortening the period of time, over which the sheet-retaining configuration is subjected to the full pressure following the opening of the control valve which connects the sheet-retaining configuration to a suction-air source or blowing-air source, to a considerable extent in comparison with long flexible hose lines.

A further advantage of the air feeding device according to the invention is that it permits very large relative movements of the sheet-retaining configuration, which are imparted to the sheet-retaining configuration. This is done, for example, via a corresponding gear mechanism, both as a rotary or pivoting movement and as a linear movement.

In addition, the air feeding device according to the invention is exposed to only a very low level of wear, which is restricted predominantly to the sealing elements used in the air feeding device. It is nevertheless possible for the latter to be easily exchanged in an extremely short period of time.

A further advantage is that the air feeding device of the invention, according to a particular embodiment of the invention, may be configured in such a way that use is made of an annular interspace connected via a first connecting bore, to the air through-passage duct in the interior of the first and the second hollow tubes, which are displaceable telescopically relative to one another, in the case of a corresponding selection of the cross-sectional surface areas of a first and a second sliding sealing ring sealing the annular interspace. In that case, the axial forces to which the sucker gear mechanism is subjected by the air feeding device according to the invention, i.e., the forces in the direction of the linear displacement path, may be such that the sucker gear mechanism is subjected to a predetermined force. That force may advantageously be utilized in order to compensate for play in the sucker gear mechanism.

Other features which are considered as characteristic for the invention are set forth in the appended claims.

Although the invention is illustrated and described herein as embodied in a device for feeding suction air or blowing air in a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
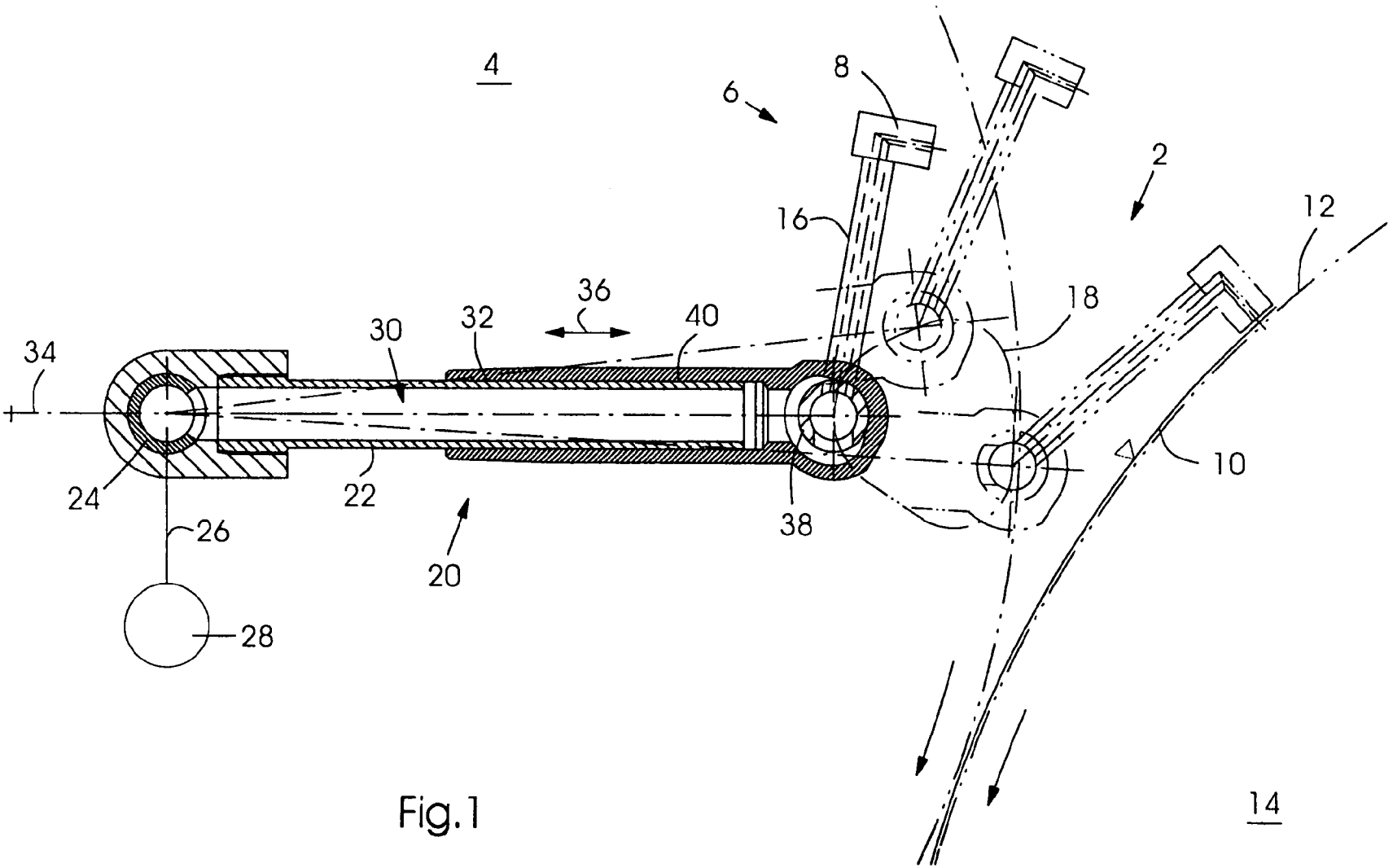
FIG. 1 is a diagrammatic, sectional view of the device according to the invention for feeding suction air to a sheet-retaining configuration in the form of a suction gripper which, through a non-illustrated sucker gear mechanism, is to be displaced along a curved path that is shown in phantom into different positions that are likewise illustrated in phantom as well.

Referring now to the figures of the drawings in detail and first, particularly, to FIG. 1 thereof, there is seen a sheet-turning or reversing device 2 (of, for example, a sheet-fed rotary printing machine) with a turning or reversing drum 4 operating in accordance with the so-called single-drum reversing or turning principle. The reversing drum 4 accommodates thereon a sheet-retaining device 6 according to the invention, which includes a suction gripper 8 that is pivotable and is additionally displaceable linearly in relation to the reversing drum 4 via a non-illustrated gripper gear mechanism or transmission. The suction gripper 8 is extensible out of or beyond the periphery of the reversing drum 4 by the gripper gear mechanism, in the manner illustrated by phantom lines in FIG. 1, and grips the trailing edge of a sheet 10, which is guided on the circumferential surface 12 of an impression cylinder 14 disposed upstream of the reversing device 2, in order to reverse or turn the respective sheet 10.

In order to carry out the reversing or turning operation, the suction gripper 8, which is fastened onto a retaining arm 16, is pivoted along a curved path 18 represented by phantom lines in FIG. 1, and simultaneously displaced linearly until it butts against or abuts the trailing edge of the sheet 10.

According to FIG. 1, the suction gripper 8 is connected to the device 20 according to the invention for feeding suction air or blowing air. The device 20 includes a first hollow tube 22 which, via one end thereof, is in flow connection with a suction-air source or a blowing-air source 28 via a first rotary-joint air-supply connection 24 and via a diagrammatically depicted connecting line 26.

As can also be ascertained from FIG. 1, the first hollow tube 22 which, in general terms, forms a first air-feeding element, is accommodated telescopically with an air through-passage duct 30 formed in a second air-feeding element formed as a second hollow tube 32. In the embodiment of the invention illustrated in FIG. 1, the first hollow tube 22 and the second hollow tube 32 are displaceable at least approximately linearly in the direction of a double-headed arrow 36 with respect to a longitudinal axis 34. In this regard, the end of the second hollow tube 32 is connected in terms of flow in the same way as the opposite end of the first hollow tube 22, via a second rotary-joint air-supply connection 38 to the air-supply line in the retaining arm 16 of the suction gripper 8.

As can also be ascertained from FIG. 1, the external diameter of the first hollow tube 22 is slightly smaller than the approximately equal internal diameter of the second hollow tube 32, so that a sliding gap 40 is formed between the outer surface of the first hollow tube 22 and the inner surface of the second hollow tube 32. The sliding gap 40 serves for respectively preventing and at least reducing the escape of leakage air from the air through-passage duct 30, when the first hollow tube 22 is being displaced along the axis 34.

In this embodiment of the invention, provision may advantageously be made for the outer surface of the first hollow tube 22 and the inner surface of the second hollow tube 32 to be produced from different materials, for example from metal and plastic, or to be respectively coated with such different materials, so as to permit wear-free dry running of the first hollow tube 22 in relation to the second hollow tube 32, without having to require the use of additional lubricants. It is thus conceivable, for example, for the surface of one of the two hollow tubes 22 and 32 to be coated with teflon, i.e., polyetrafluoroethylene, whereas the surface of the other hollow tube 22 or 32, as the case may be, may be formed of metal, for example of steel.

According to a further configuration of the concept upon which the invention is based, the first hollow tube 22 is sealed by a suitable sealing element in relation to the second hollow tube 32, against the escape of leakage air.

Figure 2:
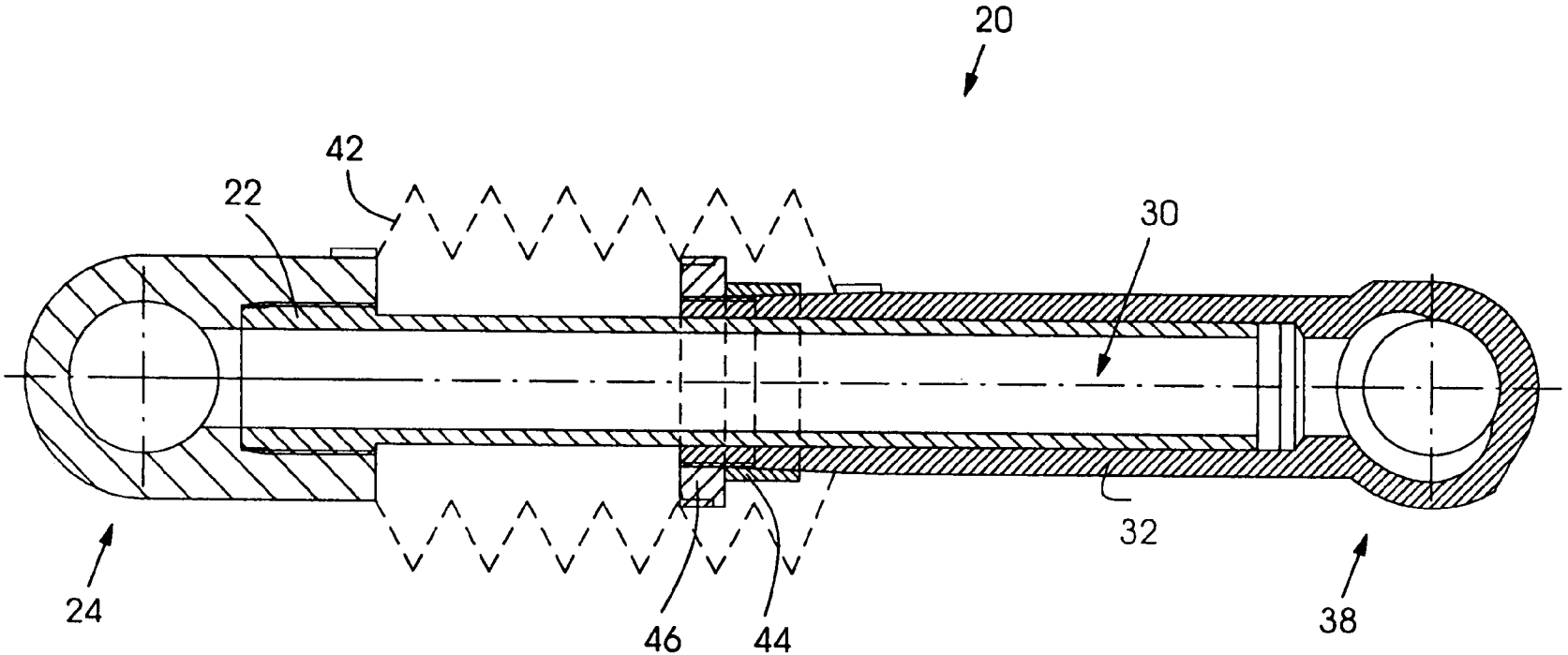
FIG. 2 is an enlarged, fragmentary, sectional view of FIG. 1, showing a further embodiment of the device according to the invention, wherein a first hollow tube is sealed in relation to a second hollow tube by an axially displaceable internally conical ring, which engages around an end of the second hollow tube, and by a threaded nut.

The sealing element may be formed, for example, by a folding bellows 42 represented diagrammatically by broken lines in FIG. 2, which encloses the first and/or second hollow tube 22 and 32, respectively, and prevents leakage air from escaping from the air through-passage duct 30 during displacement of the first hollow tube 22 in relation to the second hollow tube 32.

In a similar manner, however, provision may likewise be made for the sealing element to be formed by an internally conical ring 44 preferably disposed at that end of the second hollow tube 32, which is located opposite the second rotary-joint air-supply connection 38, and cooperates with a threaded nut 46, which can be screwed onto an otherwise non-illustrated thread formed on the second hollow tube 32, so that the hollow tube 32 is forced radially inwardly when the threaded nut 46 is tightened, due to which it is possible to adjust the size of the gap between the tubes 22 and 32 and thus the quantity of leakage air escaping between the outside of the first hollow tube 22 and the inside of the second hollow tube 32.

Figure 3A:
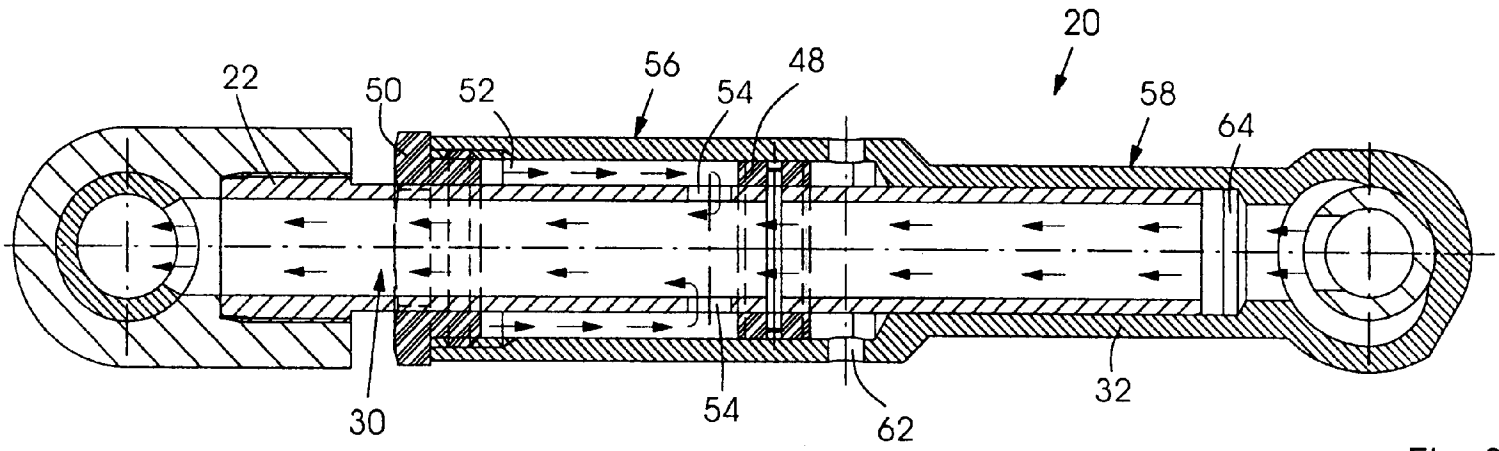
FIG. 3A is a view similar to that of FIG. 2 of another embodiment of the device according to the invention, wherein first and second sealing elements are formed by first and second sliding sealing rings which define an annular interspace that is in flow connection, via a connecting bore, to an air through-passage duct formed in the interior of the first and second hollow tubes.

According to a further embodiment of the invention illustrated in FIG. 3A, the sealing element is formed by a first sliding sealing ring 48 which is disposed between the outer surface of the first hollow tube 22 and the inner surface of the second hollow tube 32 and is fastened on the first hollow tube 22. The first sliding sealing ring 48 may be fastened, in this regard, for example with the aid of an otherwise non-illustrated pin, by adhesive bonding of the first sliding sealing ring 48 or in some other way.

According to FIG. 3A, also disposed on the second hollow tube 32 is a second sliding sealing ring 50, which seals the outer surface of the first hollow tube 22 in relation to the inner surface of the second hollow tube 32 and is preferably formed as a closing sealing ring which seals the end of the second hollow tube 32.

As can also be ascertained from FIG. 3A, the first sliding sealing ring 48 and the second sliding sealing ring 50 define an annular interspace 52 which is connected, in terms of flow, via a first connecting bore 54, to the air through-passage duct 30 in the interior of the first hollow tube 22. The annular interspace 52, in this regard, is preferably formed by a widened section 56 of the second hollow tube 32.

Figure 3B:
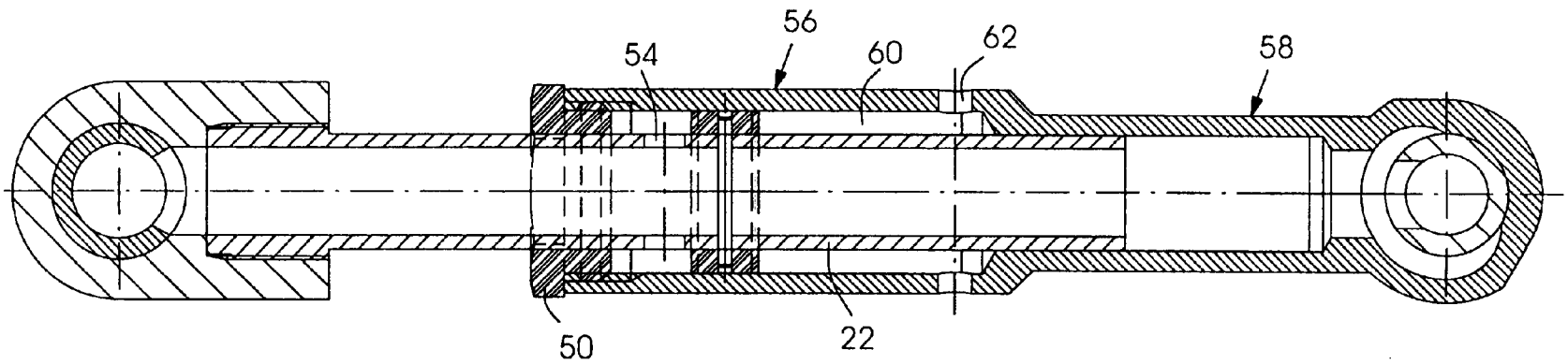
FIG. 3B is another view of the device which is illustrated in FIG. 3A, wherein the device according to the invention is shown telescopically extended so as to form a second annular interspace.

As shown in a telescopically extended view of the feeding device 20 in FIG. 3B, a second annular interspace 60, which is produced by the first sliding sealing ring 48 and a section of reduced diameter 58 of the second hollow tube 32 and is required for the free movement of the first sliding sealing ring 48 during displacement of the first and second hollow tubes relative to one another, is in flow connection, via a second connecting bore 62, with the surroundings, in order to permit air to be admitted into the second annular interspace 60.

With the introduction of suction air into the air through-passage duct 30, in the case of the aforedescribed configuration of the feeding device 20 according to the invention, a negative pressure is likewise produced via the first connecting bore 54 in the first annular interspace 52, the negative pressure resulting in the second sliding sealing ring 50, which is connected to the second hollow tube 32, being forced, by the negative-pressure action, in the direction of the first sliding sealing ring 48, which is connected to the first hollow tube 22. Accordingly, the negative pressure acting upon the cross-sectional surfaces of the first sliding sealing ring 48 and of the second sliding sealing ring 50 via the first connecting bore 54 in the first annular interspace 52 attempts to move the first hollow tube 22 and the second hollow tube 32 axially away from one another, the magnitude of the force acting, in this regard, being determined by the cross-sectional surface area of the first sliding sealing ring 48 and the cross-sectional surface area of the second sliding sealing ring 50, respectively. The axial force produced in the first annular interspace 52 can be increased, in a manner according to the invention, by an increase in the cross-sectional surface area of the first and/or the second sliding sealing rings 48, 50 and reduced by a corresponding decrease in the cross-sectional surface area.

According to an advantageous configuration of the invention, in the case wherein no additional forces produced by the feeding device 20 according to the invention act upon the sucker gear mechanism in order to move the suction gripper 8, the cross-sectional surface area of the first annular interspace 52, i.e. the cross-sectional surface area of the first sliding sealing ring 48, or the cross-sectional surface area of the second sliding sealing ring 50 which encloses the first interspace 52 is preferably at least approximately equal to the effective cross-sectional surface area 64 of the air through-passage duct 30 in the second hollow tube 32, with the result that the axial forces at least approximately cancel one another out.

According to a further embodiment of the invention, wherein the sucker gear mechanism is subjected to a compressive force acting thereon, the cross-sectional surface area of the first annular interspace 52 is larger than the cross-sectional surface area 64 of the air through-passage duct 30 in the second hollow tube 32, so that the forces produced in the first annular interspace 52 which attempt to move the first hollow tube 22 and the second hollow tube 32 axially apart from one another are greater than the opposing forces which are produced by the cross-sectional surface 64 in conjunction with the suction air in the air through-passage duct 30 and move the first and the second hollow tubes 22 and 32 toward one another. This results in a compressive force to which the gear mechanism of the retaining configuration is subjected by the first and the second hollow tubes 22 and 32 and which can serve for eliminating play that is produced in the gear mechanism and is caused, for example, by the tooth-flank play of gearwheels of the gear mechanism or by joint play, and which usually adversely affects the positioning accuracy of the suction gripper 8.

It is possible in the same way, by reducing the cross-sectional surface area of the first interspace 52 in comparison with the cross-sectional surface area 64 of the air through-passage bore in the second hollow tube 32, in the presence of suction air in the air through-passage duct 30 between the first hollow tube 22 and the second hollow tube 32, to produce a net overall force which moves the two hollow tubes toward one another and can serve for subjecting the gripper gear mechanism of the retaining configuration 6 to a tensile force, so that, in the same manner as has been described hereinabove, the positioning accuracy of the suction gripper is increased.

Furthermore, it also possible for the feeding device 20 according to the invention to serve for feeding blowing air to a pneumatic air-feeding device of a printing machine which is subjected to the action of blowing air. Such a device may be, for example, a blowing configuration which is moved along a specified path together with a given part of the printing machine, for example a cylinder, a drum or a gripping device of a reversing or turning device.

It is also conceivable for the feeding device according to the invention to be used for supplying suckers in the feeder of a sheet-fed rotary printing machine or for supplying pneumatic guide devices which are subjected to the action of suction air or blowing air and are located in folders of web-fed rotary printing machines.

I claim:

1. A device for feeding one of suction air and blowing air to a sheet-retaining device displaceable relative to a machine element in a sheet-fed rotary printing machine having a reversing device and a cylinder with a periphery, the machine element being a suction gripper of the reversing device pivotable out of the periphery of the cylinder of the printing machine, the air feeding device comprising:

a first air-feeding element to be connected in terms of flow to an air source for one of suction-air and blowing-air;

a second air-feeding element cooperating telescopically with said first air-feeding element for forming an air through-passage duct connected in terms of flow to the sheet-retaining device;

said first and second air-feeding elements being first and second hollow tubes to be inserted telescopically inside one another;

said first hollow tube being sealed by a sealing element relative to said second hollow tube, for preventing an escape of leakage air;

said sealing element including a first sliding sealing ring disposed between an outer surface of said first hollow tube and an inner surface of said second hollow tube, and fastened onto said first hollow tube, and a second sliding sealing ring fastened onto said inner surface of said second hollow tube and together with said first sliding sealing ring defining an annular interspace between said outer surface of said first hollow tube and said inner surface of said second hollow tube.

2. The air feeding device according to claim 1, wherein said second air-feeding element is to be displaced at least approximately linearly relative to said first air-feeding element.

3. The air feeding device according to claim 1, wherein said first hollow tube has an external diameter corresponding approximately to an internal diameter of said second hollow tube, forming a sliding gap, between an outer surface of said first hollow tube and an inner surface of said second hollow tube, for reducing an escape of leakage air.

4. The air feeding device according to claim 3, wherein said outer surface of said first hollow tube and said inner surface of said second hollow tube are formed of different materials, for affording wear-free dry running of said first hollow tube in relation to said second hollow tube.

5. The air feeding device according to claim 4, wherein said different materials are plastic material and metal.

6. The air feeding device according to claim 1, wherein said second sliding sealing ring is a closing sealing ring disposed at an end of said second hollow tube.

7. The air feeding device according to claim 1, wherein said annular interspace is connected, in terms of flow, through a first connecting bore to an air through-passage duct for guiding one of suction air and blowing air in an interior of said first hollow tube.

8. The air feeding device according to claim 7, wherein said annular interspace and said air through-passage duct in said second hollow tube have cross-sectional surface areas dimensioned for causing axial forces, to be produced by one of suction air and blowing air in said annular interspace and in said air through-passage duct and acting upon said first and said second hollow tubes, to at least approximately cancel one another out.

9. The air feeding device according to claim 7, wherein a cross-sectional surface area of said annular interspace and a cross-sectional surface area of said air through-passage duct in said second hollow tube are dimensioned to cause the forces to be produced by suction air in said annular interspace for moving said first hollow tube and said second hollow tube away from one another, to be greater than the forces to be produced by the suction air in said air through-passage duct for moving said first hollow tube and said second hollow tube towards one another.

10. The air feeding device according to claim 7, wherein a cross-sectional surface area of said annular interspace and a cross-sectional surface area of said air through-passage duct in said second hollow tube are dimensioned to cause the forces to be produced by suction air in said annular interspace for moving said first hollow tube and said second hollow tube away from one another, to be smaller than the forces to be produced by the suction air in said air through-passage duct for moving said first hollow tube and said second hollow tube towards one another.

* * * * *